US007000670B2

(12) United States Patent
Kwon et al.

(10) Patent No.: US 7,000,670 B2
(45) Date of Patent: Feb. 21, 2006

(54) BLIND AND METHODS FOR OPERATING THEREOF

(76) Inventors: Young Sun Kwon, 302-66 Gayang-Dong, Dong-Gu, Daejeon (KR) 300-837; Oh Hoon Kwon, 510-13 Sillim-Dong, Kwanak-Gu, Seoul (KR)

( * ) Notice: Subject to any disclaimer, the term of this patent is extended or adjusted under 35 U.S.C. 154(b) by 0 days.

(21) Appl. No.: 10/304,141

(22) Filed: Nov. 25, 2002

(65) Prior Publication Data

US 2003/0173036 A1 Sep. 18, 2003

(30) Foreign Application Priority Data

Mar. 14, 2002 (KR) ..... 10-2002-0013810

(51) Int. Cl.
*E06B 9/30* (2006.01)

(52) U.S. Cl. ..... 160/107; 160/168.1 R

(58) Field of Classification Search ..... 160/107, 160/172 R, 168.1 R, 173 R, 176.1 R, 177 R, 160/84.06
See application file for complete search history.

(56) References Cited

U.S. PATENT DOCUMENTS 2,389,956 A * 11/1945 Castilonia ..... 160/172 R
2,639,766 A * 5/1953 Pratt ..... 160/40
4,333,510 A * 6/1982 Fox ..... 160/177 R
4,643,238 A * 2/1987 Tachikawa et al. ... 160/168.1 R
5,074,349 A * 12/1991 Yannazzone ..... 160/177 R
5,826,638 A * 10/1998 Jelic ..... 160/107
5,996,668 A * 12/1999 DeBlock et al. ..... 160/107
6,601,633 B1 * 8/2003 Sun et al. ..... 160/107
2003/0075285 A1 * 4/2003 Anderson et al. ..... 160/90

FOREIGN PATENT DOCUMENTS

KR 20-0211757 8/1999
KR 20-242601 1/2000
KR 1993-0003878 1/2000

* cited by examiner

*Primary Examiner*—Blair M. Johnson
(74) *Attorney, Agent, or Firm*—Nixon Peabody LLP

(57) ABSTRACT

A blind which includes: a rectangular frame; windows fit on the front and rear surfaces of the frame; a slat part embedded in between the windows mounted on the front and rear surfaces of the frame; an upper movable part and drum parts mounted on a back headrail half and a front headrail half of the upper portion of the frame to control the slat part; a side movable part inserted into a side guiderail of a side of the frame; and pull cords connected to the slat part, the drum parts, the side movable part, and corner keys for controlling opening and closing of the blind.

28 Claims, 10 Drawing Sheets

【Fig.1】
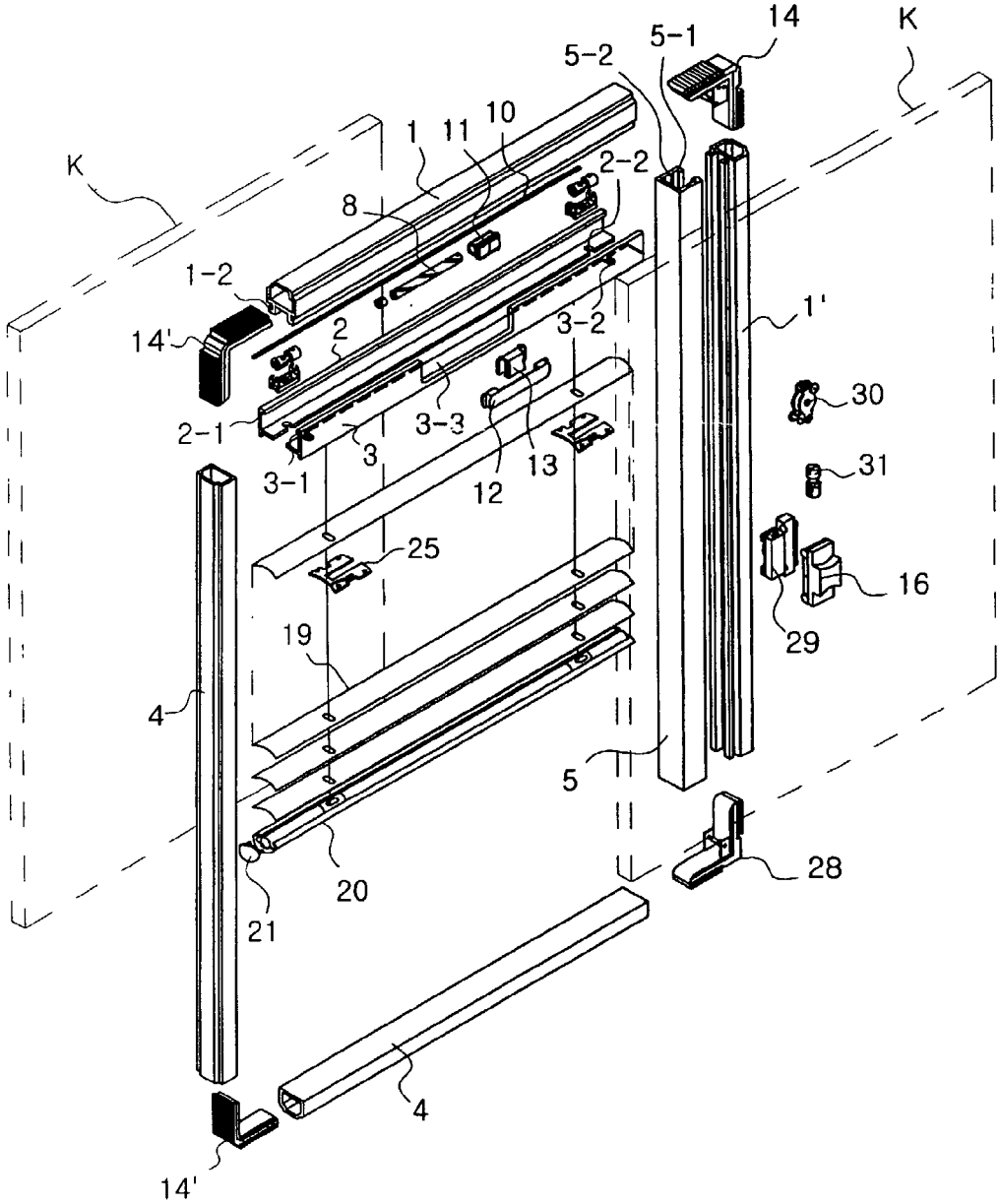

【Fig.2】
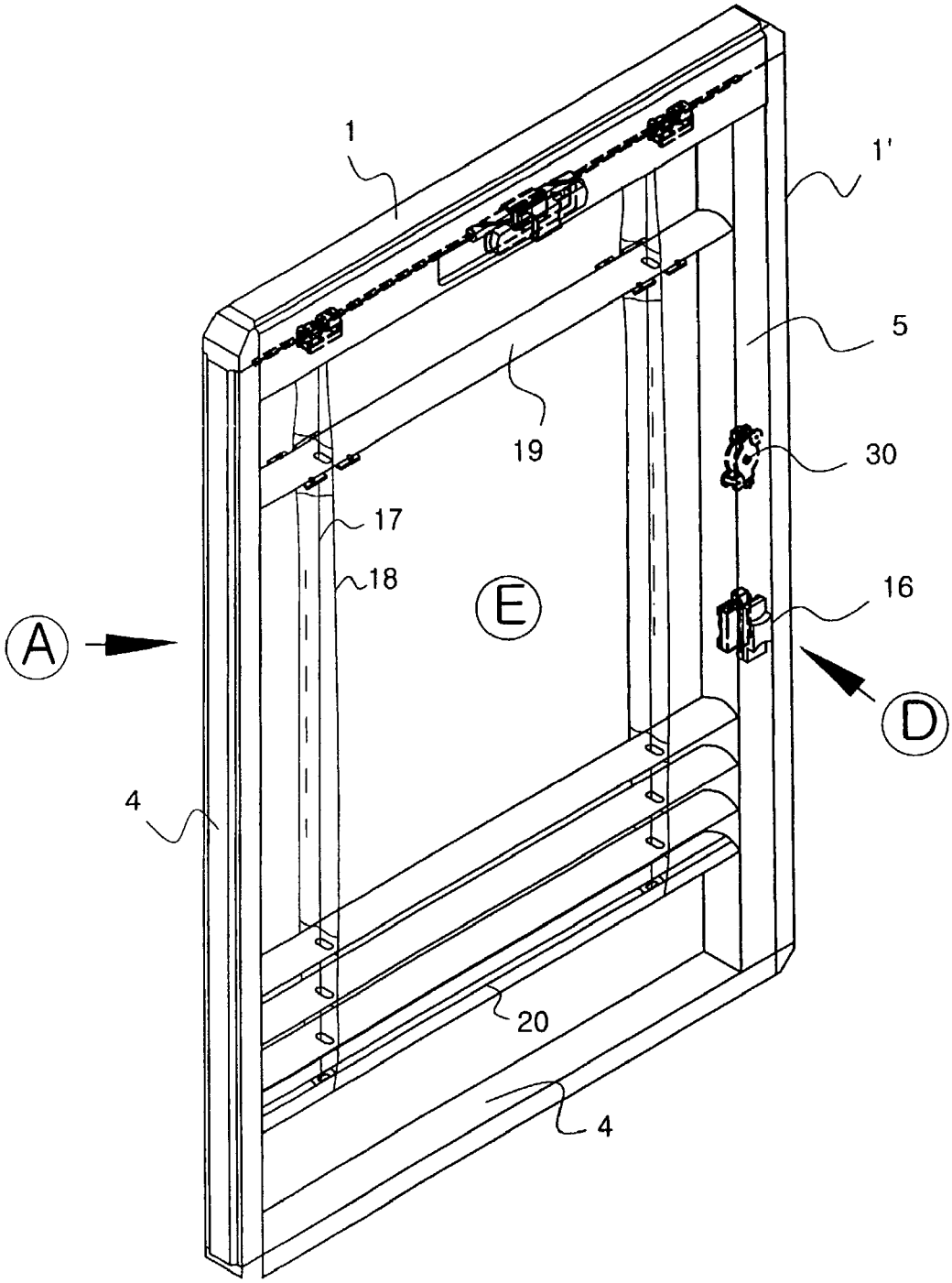

【Fig.3】
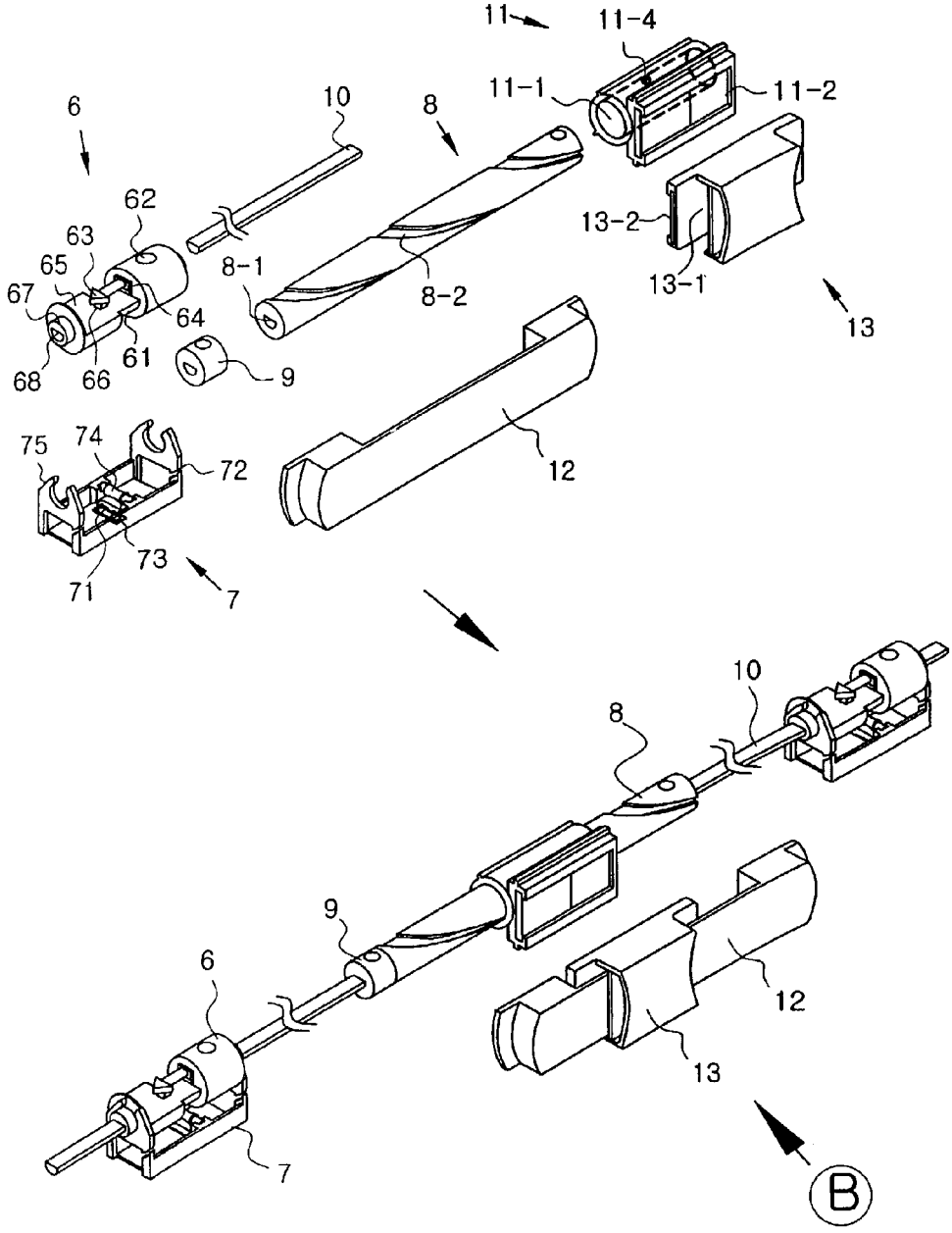

【Fig.4】
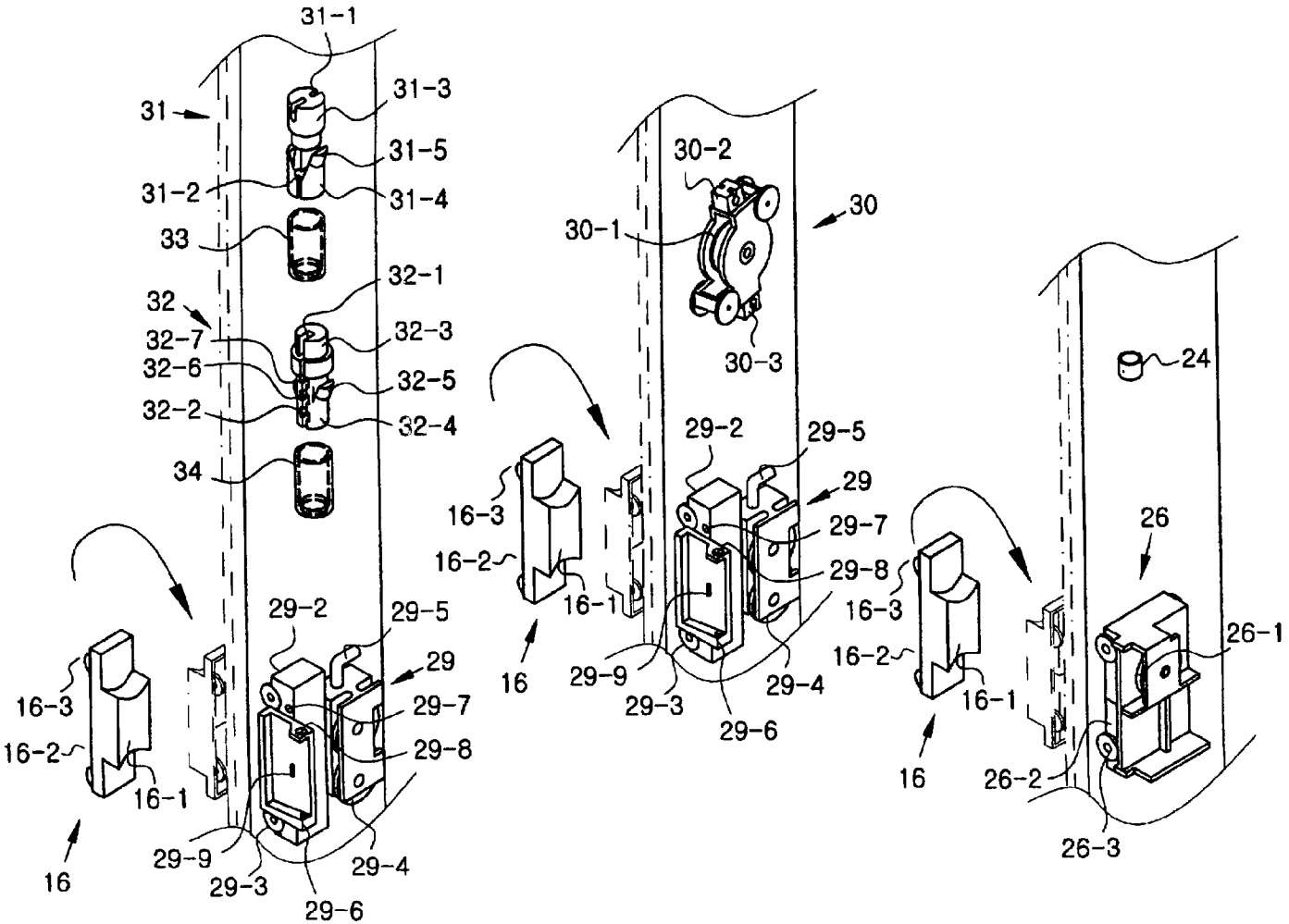

【Fig.5】
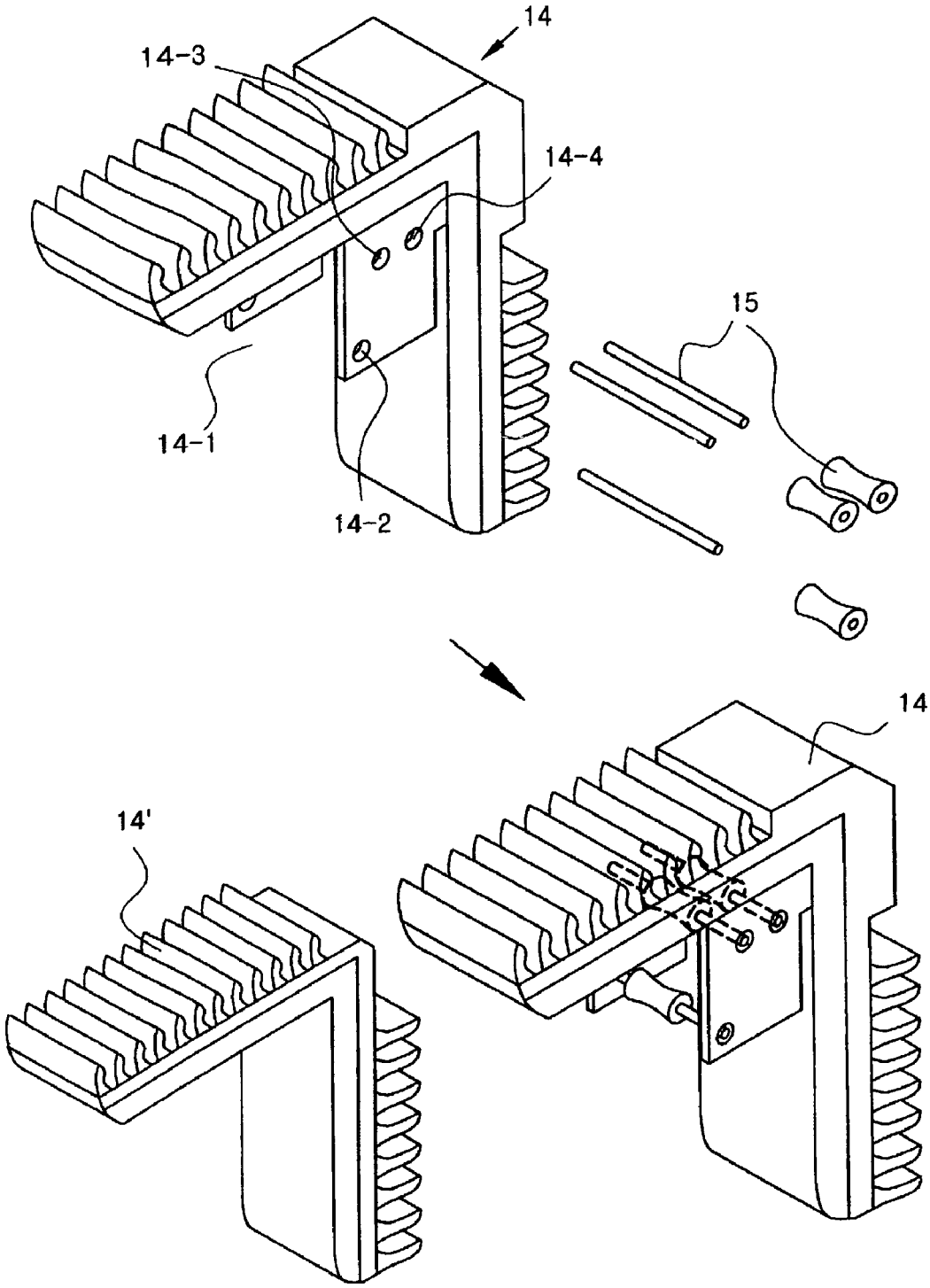

【Fig.6】
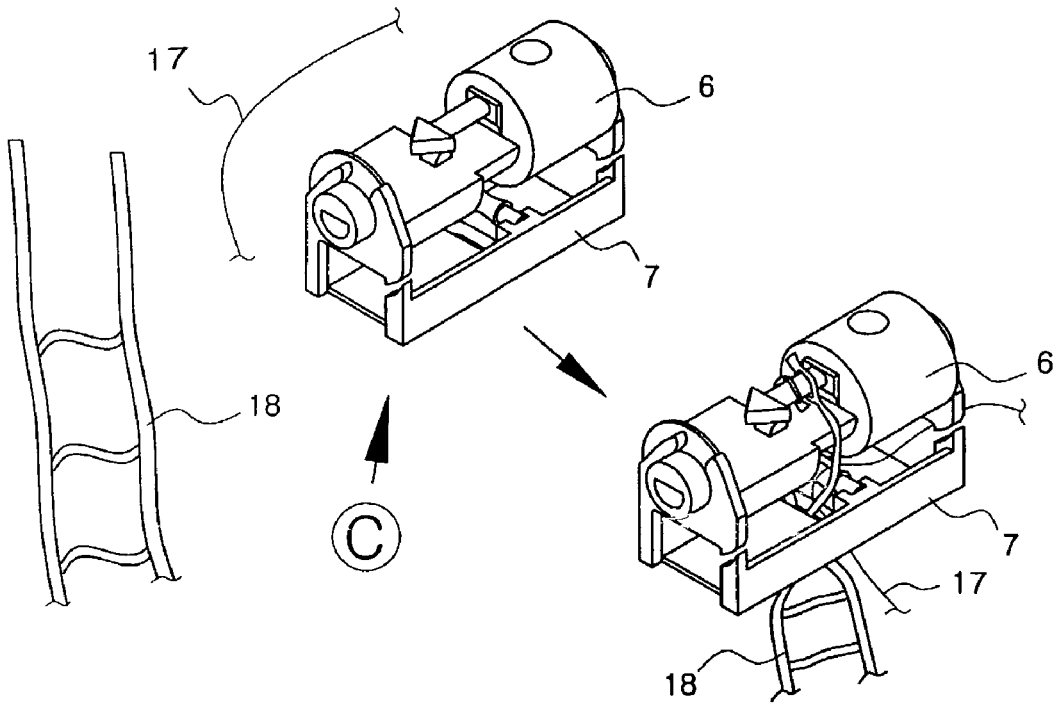
【Fig.7】
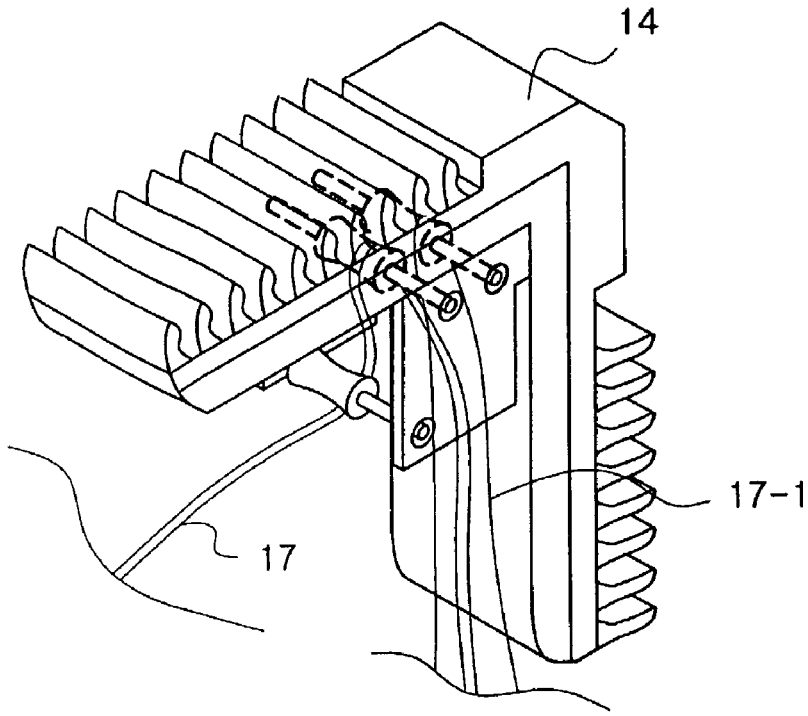

【Fig.8】
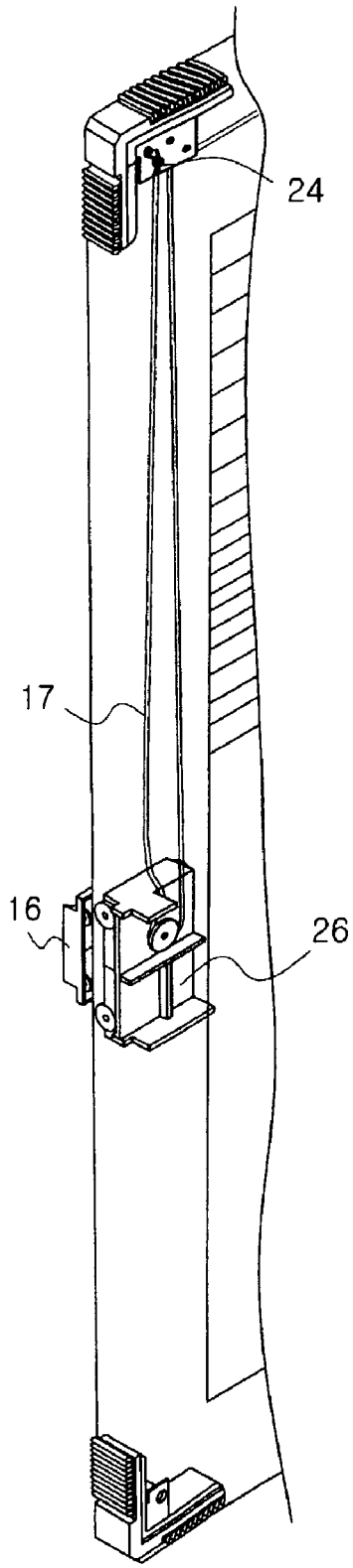

【Fig.9】
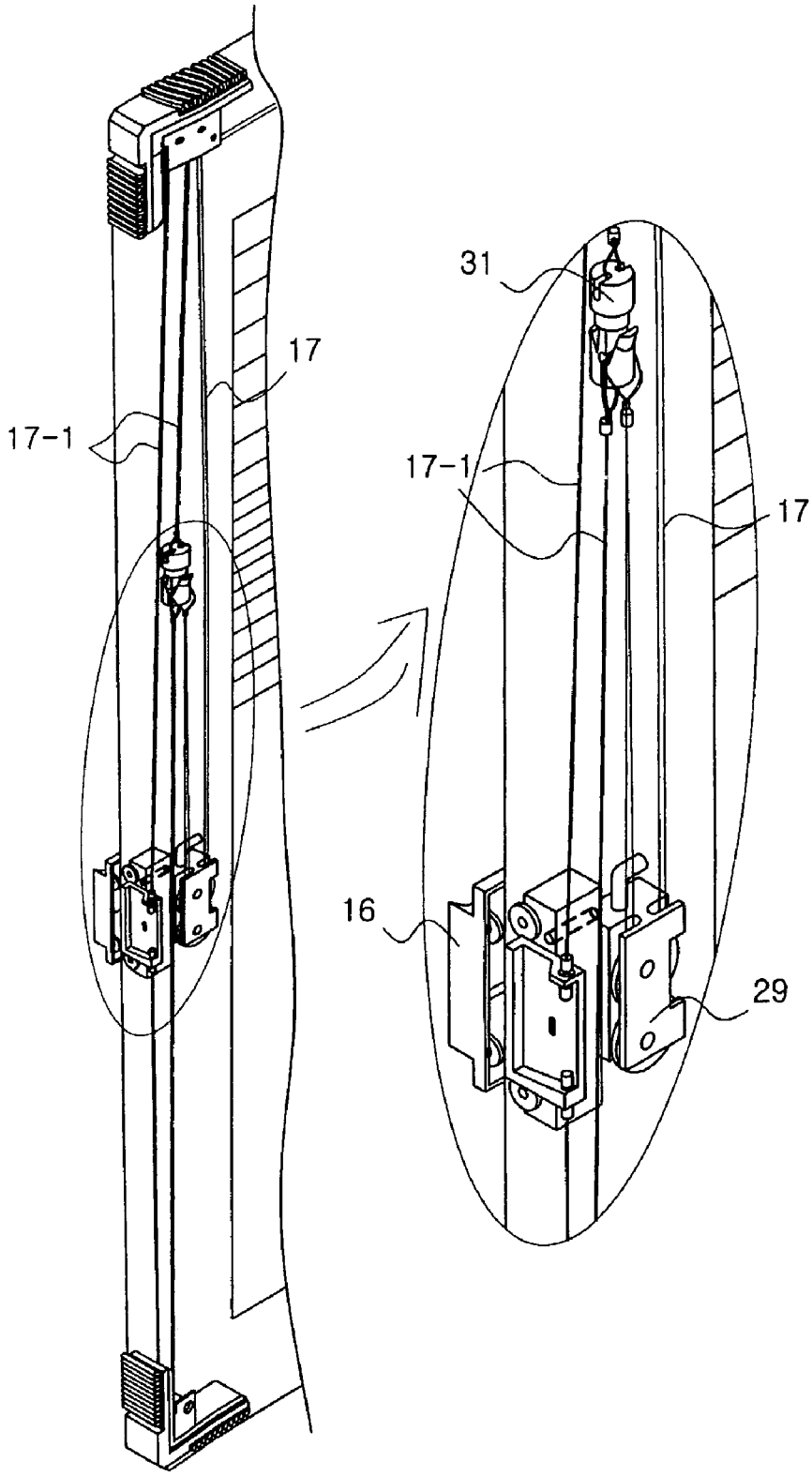

【Fig.10】
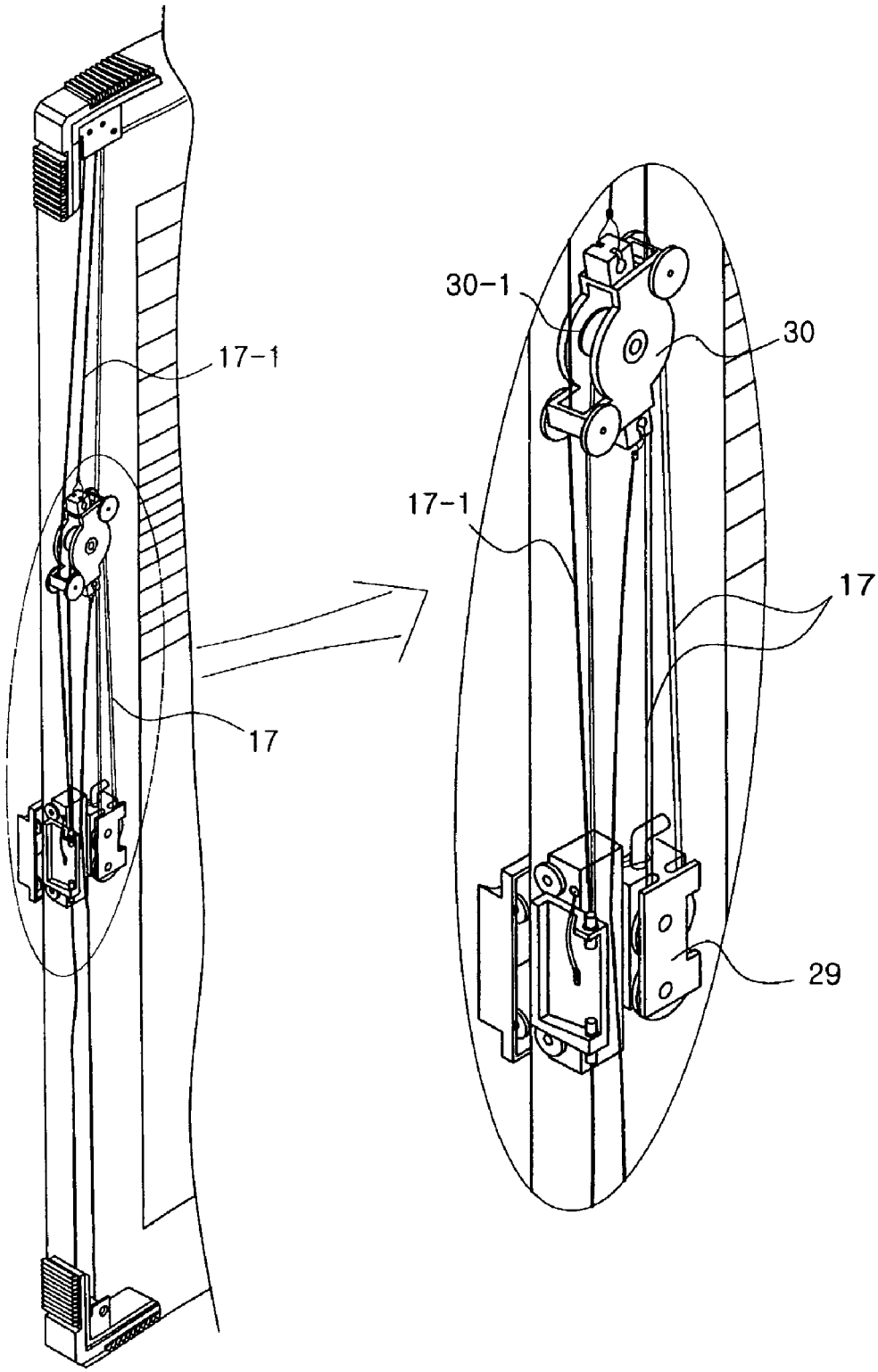

BLIND AND METHODS FOR OPERATING THEREOF

FIELD

The present invention relates to a blind, and more particularly, to a blind seated in between double windows and methods for operating thereof.

BACKGROUND

In general, a blind is to exclude sunlight or to prevent someone from looking in a window, and has been installed onto a veranda or a window wall.

Double windows K have been used in multistoried buildings or buildings located on a noisy street. When the blind is installed on the double windows, it is installed between the double windows K for fine appearance with regard to the thickness of the double windows K or for preventing the blind from being covered with dust. However, there is a problem that a user has to operate the blind, which is installed in the sealed inside of the building from the outside to open and close the blind. So, there have been lots of studies to solve the above problem.

Korean Utility Model Publication No. 20-242601 discloses a shield device mounted between double windows K for excluding sunlight. Also, Korean Utility Model Publication No. 1993-0003878 discloses a partition, in which a blind is embedded, and Korean Utility Model Publication No. 20-0211757 discloses a device for controlling irradiant of sunlight and varying an advertising film through the double windows K.

However, the prior arts have several problems. It is complicated to open and close the blind installed inside the sealed double windows K and that the blind must be generally leveled at a predetermined angle, but is leaned to one side.

SUMMARY

Accordingly, the present invention is directed to a blind that substantially obviates one or more problems due to limitations and disadvantages of the related art.

The present invention provides a blind, which includes a frame for forming double windows, frame corner keys, an upper movable part and drum parts mounted on the upper portion of the inside of the frame, a side movable part embedded in a side of the frame, and a slat part mounted in the blind.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

The blind includes: a rectangular frame; windows fit on the front and rear surfaces of the frame; a slat part embedded in between the windows mounted on the front and rear surfaces of the frame; an upper movable part and drum parts mounted on a back headrail half and a front headrail half of the upper portion of the frame to control the slat part; a side movable part inserted into a side guiderail of a side of the frame; and pull cords connected to the slat part, the drum parts, the side movable part and corner keys for controlling opening and closing of the blind.

The back headrail half and the front headrail half, which are located on the lower portion of a guiderail holder, are curved, and so, easily fit to each other. A side guiderail engages the lower end of the guiderail holder firmly. A webbing roller, which has a narrower part at the center, allows a ladder string to be easily inserted through a webbing roller support center hole. Furthermore, the webbing roller has a bolt hole, which is formed in the upper portion of the webbing roller for fixing a shaft, formed in a position different from the bolt hole of the conventional blind, and so allows a bolt to be directly fastened without rotating the webbing roller.

A webbing roller ladder string fixing end 63 has a sharp arrow part of suitable length so as to easily make a hole in the ladder string. A webbing roller ladder string fixing body, which has the same thickness as the hole of the ladder string, prevents the ladder string from moving easily, and a webbing roller flat top 65, which is formed to the widest degree, allows the ladder string to be inserted easily. A webbing roller ladder string fixing body supporter has a protrusion for serving to prevent an arrowhead part of the webbing roller ladder string fixing end from being drooped and to prevent separation of the ladder string. A webbing roller support center hole 71, which has the width equal to the diameter of a webbing roller center hole, improves a slat closing effect. A webbing roller support side cut allows the pull cords to be inserted easily.

A helical gear through hole of a helical gear is formed in a position corresponding to a flat portion of the shaft, and so a user can tighten a bolt without rotating the helical gear. A helical gear fixture formed on the shaft prevents slip of the helical gear.

An inner tilting mechanism has a magnet inserting hole for attaching a magnet, and so the magnet is firmly fit to the magnet inserting hole without separation or slip.

A pulley set is mounted in a corner key hole of the corner key to prevent bending of the pull cord and to reduce friction coefficient.

A roller is mounted on a side of a magnet inserting hole of an up-down handle, so that the up-down handle can be moved up and down smoothly because rolling of the roller reduces friction coefficient largely even though magnetic force is strong.

The ladder string of the conventional blind is 15 mm–16 mm in width and 12 mm in height for the slat part, but the ladder string of the present invention is 13 mm in height to have equally folded shape and has a hole at the center between knots of the ladder string.

The hole of the ladder string is fit on a webbing roller ladder string fixing protrusion and the webbing roller ladder string fixing body, and the ladder string is supported horizontally by a webbing roller ladder string fixing body supporter, so that the ladder string can maintain at a level.

Inner pull cord holders have pulleys respectively to improve a pull cord tying method and to reduce friction coefficient.

An inner pull cord holder pulley, a cord fixing part of the inner pull cord holder, an inner pull cord holder side supporter hole, a magnet inserting hole, a roller, and first to third distance shortening devices are mounted, so that the vertical movement distance of the blind when the up-down handle is moved vertically can be reduced to ⅕, ⅓ or ½.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a detailed view of a blind according to an embodiment of the present invention;

FIG. 2 is a detailed view of an assembled frame part of the blind according to the present invention;

FIG. 3 is an exploded view of an upper movable part and a drum part of the blind;

FIG. 4 is a detailed exploded view of a side movable part of the blind;

FIG. 5 is a detailed view showing assembling and disassembling processes of corner keys of the blind;

FIG. 6 is a view showing a connected state of a pull cord of the drum part of the blind;

FIG. 7 is a view showing a connected state of the pull cord of the corner key of the blind;

FIG. 8 is a view showing a state that the blind is moved twice;

FIG. 9 is a view showing a state that the blind is moved three times;

FIG. 10 is a view showing a state that the blind is moved five times; and

DETAILED DESCRIPTION

Figure 11:
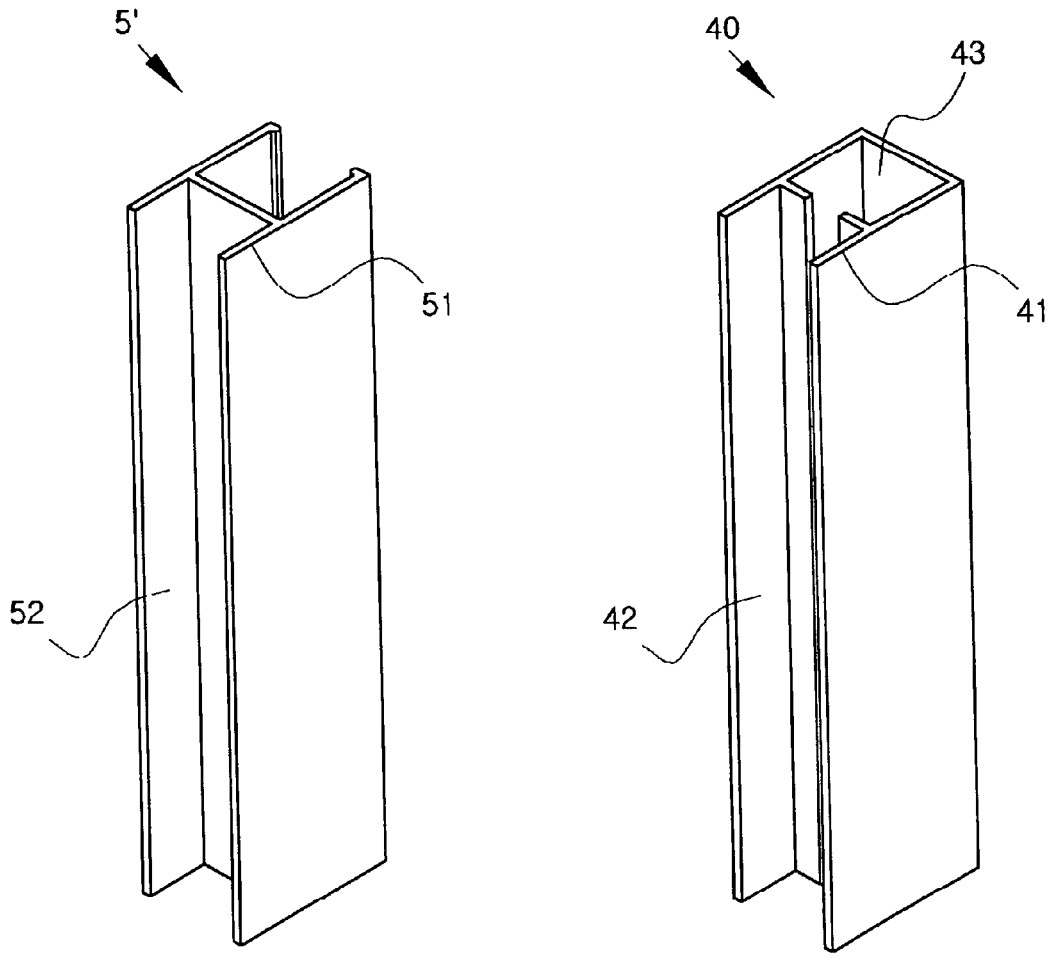
FIG. 11 is a view of another example of a space bar cover and a side guiderail according to the present invention.

Reference will now be made in detail to the preferred embodiments of the present invention, examples of which are illustrated in the accompanying drawings.

In the drawings, there are a guiderail holder 1, a guiderail holder bottom 1-2, a back headrail half 2, fixing projections 2-1, 3-1, and 5-1, holes 2-2 and 3-2, a front headrail half 3, a cut portion 3-3, space bars 4, a side guiderail 5 or 5', a side guiderail fixing part 5-1, a guide protrusion 5-2, webbing rollers 6, webbing roller supports 7, a helical gear 8, a helical gear through hole 8-1, a helical gear groove 8-2, a helical gear fixture 9, a shaft 10, an inner tilting mechanism 11, a helical gear inserting hole 11-1, magnet inserting grooves 11-2, 13-2, 16-2, 26-2 and 29-2, rollers 11-3, 13-3, 16-3, 26-3 and 29-3, a protrusion 11-4, a tilting mechanism cover 12, a front tilting mechanism 13, a tilting mechanism cover inserting hole 13-1, corner keys 14, 14' and 28, a corner key space 14-1, corner key holes 14-2, 14-3 and 14-4, a number of pulley sets 15, an up-down handle 16, an up-down handle top 16-1, pull cords 17, an idle cord 17-1, a ladder string 18, alu slats 19, a bottomrail 20, a bottomrail end cap 21, a bottomrail weight rod 22, a ladder string bottom 23, an equalizing device 24, slat spacers 25, inner pull cord holders 26 and 29 with magnet, a rotary winder 26-1, an inner pull cord holder pulley 29-4, a cord fixing part 29-5 of the inner pull cord holder, an inner pull cord holder side supporter 29-6, a first distance shortening device 30, pulley 30-1, connectors 30-2 and 30-3, holes 31-1 and 32-1, second and third distance shortening devices 31 and 32, second and third distance shortening device tops 31-3 and 32-3, second and third distance shortening device bottoms 31-4 and 32-4, side fixing parts 31-5 and 32-5, cord fixing parts 31-2, 32-2, 32-6 and 32-7, covers 33 and 34, a space bar cover 40, side bottom extensions 42, an inserting hole 43, a side guide extension 52, a webbing roller center hole 61, a webbing roller hole 62, a webbing roller ladder string fixing end 63, a webbing roller ladder string fixing body 64, a webbing roller flat top 65, a webbing roller ladder string fixing body supporter 66, webbing roller side protrusions 67, a webbing roller fixing hole 68, a webbing roller support center hole 71, a webbing roller support side cut 72, a webbing roller support bottom protrusion 73, a webbing roller support roller 74, webbing roller supporters 75, a frame A, an upper movable part B, drum parts C, a side movable part D, a slat part E and windows K As shown in FIG. 1, the blind includes the rectangular frame A (labeled in FIG. 2), the windows K fit on the front and rear surfaces of the frame A, the slat part E embedded between the double windows K fit on the front and rear surfaces of the frame A, the upper movable part B (labeled in FIG. 3) and the two drum parts C (labeled in FIG. 7) mounted between the back headrail half 2 and the front headrail half 3 of the upper frame A to control the slat part E, the side movable part D inserted and mounted in the side guiderail 5 of the side frame A, and the pull cords 17 connected to the slat part E, the drum parts C, the side movable part D and corner keys 14 for controlling opening and closing of the blind.

The structure of the blind will now be described in more detail as follows.

The windows K are adhered onto the front and rear surfaces of the rectangular frame A with adhesive or sealing agent.

As shown in FIGS. 1, 2, the rectangular frame A includes two space bars 4 disposed on the left side and bottom thereof, and two guide rail holders 1 and 1' disposed on the top and right side thereof, the two space bars 4 and guide rail holders 1 and 1' being coupled with each other by corner keys 14, 14' and 28 thereof. The guide rail holders 1 and 1' disposed on the top and the right side of the frame A have projecting portions 1-2 formed on the bottom thereof, respectively, the back headrail half 2 and the front headrail half 3 are mounted on the guide rail holder 1 disposed on top of the frame A, and the side guiderail 5 is mounted on the guide rail holder 1' disposed on the right side of the frame A. The back headrail half 2 and the front headrail half 3 respectively have fixing projections 2-1 and 3-1 formed on the upper end portions thereof to be engaged with the projecting portion 1-2 of the guide rail holder 1 disposed on the top of the frame A, and holes 2-2 and 3-2 formed in both sides thereof. The front headrail half 3 has the cut portion 3-3 formed at the center of the side surface thereof for a tilting mechanism cover 12.

The first side guiderail 5 is opened at a side thereof and includes fixing projections 5-1 formed at both ends of the opened portion to be engaged with the projecting portion of the guiderail 1' of the right side of the frame A, and two guide protrusions 5-2 formed inside the first side guiderail 5.

As shown in FIGS. 1. 2, and 5, the corner keys 14 and 28 formed on the top and bottom of the right side of the frame A respectively include corner key space corner key space 14-1 having the corner key holes 14-2, 14-3 and 14-4 and a number of pulley sets 15 formed between the corner key holes 14-2, 14-3 and 14-4. The corner keys 14' formed on the top and bottom of the left side of the frame A do not have the corner key holes 14-2, 14-3 and 14-4 as in the corner key 14.

As shown in FIG. 3, the upper movable part B includes the helical gear part embedded in a space formed between the back headrail half 2 and the front headrail half 3 formed on the upper portion of the frame A, the helical gear movable part located on the cut portion 3-3 of the front headrail 3 and moving the helical gear part inserted therein, and the front tilting mechanism 13 mounted at a position corresponding with the helical gear part in a state that the window K is located, that is, at the outside of the window K contacted to the cut portion 3-3 of the front headrail 3, to operate the helical gear movable part.

The helical gear part includes the helical gear 8 having the helical gear groove 8-2 formed in the surface thereof spirally, the semicircular helical gear hole 8-1, and the shaft 10 inserted into the helical gear hole 8-1 of the helical gear 8.

The helical gear movable part is mounted on the cut portion 3-3 of the front headrail 3, and includes the helical gear inserting hole 11-1 formed in the lower portion for inserting the helical gear 8, the protrusion 11-4 formed vertically on the inner center of the helical gear inserting hole 11-1, and the inner tilting mechanism 11 mounted on the upper portion and having the magnet inserting groove 11-2 for inserting a magnet.

A Referring to FIGS. 1–3, front tilting mechanism part is located at the corresponding position of the helical gear movable part located across the window K, which is disposed on the outer top of the frame A, and includes the front tilting mechanism 13 projecting from the center of the frame A, the tilting mechanism cover 12 inserted into the lower portion of the front tilting mechanism 13, the tilting mechanism cover inserting hole 13-1 for inserting the tilting mechanism cover 12, and the magnet inserting groove 13-2 formed in the upper portion of the tilting mechanism cover inserting hole 13-1 for inserting the magnet.

As shown in FIG. 3, the drum part C is mounted at the same position as the upper movable part B, and includes the webbing roller 6 inserted into the shaft 10 embedded into the space formed between the back headrail half 2 and the front headrail half 3, and the webbing roller support 7 located on the lower portion of the webbing roller 6, supporting the webbing roller 6 and fixed between the back headrail half hole 2-2 and the front headrail half hole 3-2 by the webbing roller support bottom protrusion 73.

The webbing roller 6 is in the form of a cylinder and located horizontally on the side center. The webbing roller 6 includes the webbing roller fixing hole 68 for inserting the shaft 10, the webbing roller center hole 61 concaved in the central portion thereof, the webbing roller hole 62 formed from the top to the central portion of the webbing roller, the webbing roller flat top 65 formed flat on the upper portion of the webbing roller 6, the webbing roller ladder string fixing body 64 of an arrow type projecting horizontally from the upper center of the webbing roller 6 to the webbing roller flat top 65 at a predetermined interval and fixing a ladder string, the webbing roller ladder string fixing end 63 of an arrowhead type located at the end of the webbing roller ladder string fixing body 64 for fixing the ladder string, and the webbing roller ladder string fixing body supporter 66 formed between a side of the upper portion of the webbing roller flat top 65 and the lower portion of the webbing roller ladder string fixing end 63.

The webbing roller support 7 includes the webbing roller supporters 75 projecting upwardly from right and left sides for inserting the webbing roller side protrusions 67, the webbing roller support side cuts 72 formed in the front and rear side surfaces for serving as a cord inserting hole, the webbing roller support center hole 71 formed in the center thereof, the webbing roller support roller 74 formed at a side of the upper portion of the webbing roller supporter center hole 71, and the webbing roller support bottom protrusion 73 projecting from the lower portion of the webbing roller support 7 for fixing the drum part C by being inserted into the back headrail half hole 2-2 and the front headrail half hole 3-2.

As shown in FIGS. 1, 2, 4, 8–10, the side movable part D includes the inner pull cord holders 26 and 29 inserted and mounted into the side guiderail 5 of the frame A, the up-down handle 16 located at the outside of the window K closely contacted to the outside of the side guiderail 5, that is, at the corresponding position of the inner pull cord holders 26 and 29 located across the window K, and the first to third distance shortening devices 30, 31 and 32 connected with the inner pull cord holders 26 and 29 by the cord and mounted at a place inside the side guiderail 5.

As shown in FIG. 4, the first inner pull cord holder 26 includes the magnet inserting space 26-2 formed in the lower portion thereof for inserting the magnet, the roller 26-3 disposed on the surface of the magnet inserting space 26-2, and the rotary winder 26-1 inserted into a cylindrical part projecting from the upper portion thereof. The second inner pull cord holder 29 includes the magnet inserting space 29-2 formed in the lower portion thereof for inserting the magnet, the roller 29-3 disposed on the surface of the magnet inserting space 29-2, the inner pull cord holder pulley 29-4 formed at a side of the upper portion thereof, the inner pull cord holder side supporter 29-6 formed at the other side of the upper portion at a predetermined interval from the inner pull cord holder pulley 294, a through hole 29-7 formed in the upper portion of the inner pull cord roller 29-3, a through hole 29-9 formed in the center of the inner pull cord holder side supporter 29-6, a through hole 29-8 formed in the upper portion of the inner pull cord holder side supporter, and the inner pull cord holder cord fixing part 29-5 formed at an end of the inner pull cord holder pulley 29-4 for fixing the cord.

The up-down handle 16 includes the magnet inserting hole 16-2 formed in the lower portion thereof for inserting the magnet, the roller 16-3 disposed at both ends of the magnet inserting hole 16-2, and the up-down handle top 16-1 formed on the upper portion thereof The first distance shortening device 30 includes upper and lower plates, the first pulley 30-1 mounted between the upper and lower plates, and the connectors 30-2 and 30-3 formed at both ends of the upper and lower plates.

The second distance shortening device 31 shown in FIGS. 1 and 4 includes the second distance shortening device top 31-3 being in the form of a cylindrical bar. The cord fixing part 31-1 projecting from the upper portion of the second distance shortening device top 31-3 and having holes, which are formed in both sides and communicate with each other, for fixing the cord. The second distance shortening device bottom 31-4 has a cord fixing part 31-2 having a hole, which is formed from the lower surface to a portion of a side of the second distance shortening device bottom 31-4 and perforates the inside of the cord fixing part 31-2 to the other side thereof for fixing the cord. The side fixing part 31-5 formed on the side surface of the distance shortening device 31 for preventing separation of the cord inserted into the cord fixing part 31-2 of the second distance shortening device bottom 31-4 and the second distance shortening device cover 33 inserted into the second distance shortening device bottom 31-4 for fixing the fixed cord again.

The third distance shortening device 32 shown in FIG. 14 includes the third distance shortening device top 32-3 being in the form of a cylindrical bar. The cord fixing part 32-1 projecting from the upper portion of the third distance shortening device top 32-3 and having holes, which are formed in both sides and communicate with each other, for fixing the cord. The third distance shortening device bottom 32-4 has cord fixing parts 32-2, 32-6 and 32-7 having holes, which are formed from the lower surface in an upward direction of a side of the third distance shortening device bottom 32-4 and perforate the inside of the cord fixing parts to the inner center portion of the cord fixing parts for fixing knots of the cords. The side fixing part 32-5 formed on the side surface of the distance shortening device for preventing separation of the cord inserted into the cord fixing parts 32-2, 32-6 and 32-7, and the third distance shortening device cover 33 inserted into the third distance shortening device bottom 32-4 for fixing the fixed cord again.

FIG. 11 is another example of the space bar cover 40 and the side guiderail according to the present invention. The space bar cover 40 includes the space bar inserting hole 43 formed in the left side and the bottom thereof for inserting the space bars 4, and side extensions 42 projecting from both edges of a side thereof for hiding the left side and bottom of the slat.

A second side guiderail 5' includes side guiderail extensions 52 projecting from both edges of a side thereof for hiding the right side of the slats.

The slat part E is in the same form as the existing blind, and so, its detailed description will be omitted.

An assembling process will be described as follows. As shown in FIG. 3, the upper movable part B and the drum parts C are assembled beforehand. After that, as shown in FIG. 6, the pull cord 17 is inserted into the webbing roller support center hole 71, and then, inserted into holes of the slats 19, which are assembled mechanically, and knotted. The slats 19 are connected to the drum part C with the ladder string in a common way. The webbing roller support bottom protrusion 73 of the drum part C is inserted into the back headrail half hole 2-2 and the front headrail half hole 3-2.

The rectangular frame A is assembled as follows. As shown in FIGS. 1 and 2, the back headrail half 2 and the front headrail half 3 are fastened to the projecting portion 1-2 of the guiderail holder 1 by the fixing projection 2-1 of the back headrail half 2 and the fixing projection 3-1 of the front headrail half 3.

After that, the side guiderail 5 is assembled to the other side of the frame A by assembling the fixing projection 5-1 to the projection portion 1-2 of the guiderail holder 1 located on the outside. Before the assembly, the side movable part D is inserted into the side guiderail 5. The windows K are adhered on the front and rear of the rectangular frame A using the adhesive or sealing agent.

Corners of the upper and lower portions of the frame A are assembled with the corner keys 14, 14' and 28, and after that, the windows K are adhered on the front and rear of the rectangular frame A using the adhesive or sealing agent.

In the above assembly, as shown in FIG. 3, the upper movable part B is assembled as follows. First, the helical gear 8 is inserted into the helical gear inserting hole 11-1 formed in the lower portion of the inner tilting mechanism 11, and then, a magnet is inserted into the magnet inserting hole 11-2 formed in the upper portion of the inner tilting mechanism 1 1. After that, the shaft 10 is inserted into the helical gear through hole 8-1 formed in the center of the helical gear 8, and then, the two drum parts C are mounted at both ends of the shaft 10.

The shaft 10 is inserted into the webbing roller fixing hole 68 formed in the side of the webbing roller 6, and then, the webbing roller side protrusions 67 of the webbing roller 6 are inserted and fixed into the webbing roller supporters 75 formed on the both sides of the webbing roller support 7. After that, the webbing roller support bottom protrusion 73 of the webbing roller support 7 is inserted into the hole 2-2 of the back headrail half 2 and the hole 3-2 of the front headrail half 3, so that the upper movable part B is mounted between the back headrail half 2 and the front headrail half 3 located on the upper portion of the frame A.

The front tilting mechanism 13 is located at the corresponding position of the inner tilting mechanism 11, which is mounted across the upper portion of the magnet and the window K mounted of the outside of the upper portion of the frame A. The tilting mechanism cover 12 is inserted into the tilting mechanism cover inserting hole 13-1 of the lower portion of the front tilting mechanism 13. A magnet is inserted into the magnet inserting groove 13-2 of the upper portion of the tilting mechanism cover inserting hole 13-1, so that the magnet inserted into the front tilting mechanism 13 has the opposite pole to the magnet inserted into the magnet inserting hole 11-2 of the upper portion of the inner tilting mechanism 11 located across the window K.

As shown in FIGS. 1, 2, and 4, the side movable part D is assembled as follows. The inner pull cord holder rollers 26-3 and 29-3 mounted on the lower portion of the inner pull cord holders 26 and 29 are fixed on the guide protrusion 5-2 of the side guiderail 5 of the frame A. After that, a magnet is inserted into the magnet inserting hole 26-2 formed in the lower portion of the inner pull cord holder 26, and then, another magnet, which is inserted into the magnet inserting hole 16-2 of the lower portion of the up-down handle 16, is located at the corresponding position of the magnet of the inner pull cord holder 26, which is located across the window K, so that the magnet of the inner pull cord holder and the magnet of the up-down handle have opposite poles to each other.

As shown in FIGS. 1, 2, 4, and 7–10, the first to third distance shortening devices 30, 31 and 32 of the side movable part D are located inside the side guiderail 5, and are connected to the inner pull cord holder pulley 29-4, which is mounted on the upper portion of the inner pull cord holder 29, and the pulley sets 15 of corner keys 14 and 28, which are mounted on the upper and lower portions of the frame A, by the cord. The side movable part D is movable vertically according to the movement of the cord.

The connection of the slats 19, the ladder string 18 and the pull cord 17 is the same as the conventional blind, but the present invention is different from the conventional blind in that the cord is connected to the improved components inserted into the frame A, i.e., the drum parts C and the side movable part D, after being inserted into the frame A.

The cords connected between the slats of FIGS. 1 and 2 and the bottomrail 20 formed under the lowermost slat 19 serves to open and close the blind, together with the ladder string 18, on which the slats 19 are fit one by one, for controlling a tilt angle of the slats 19. The connection of the pull cord 17 inserted into holes of the slats is the same as the conventional blind.

The side guiderail 5 has the idle cord 17-1 rotating idly after being fixed to the corner keys 14 and 28 and the distance shortening devices 30, 31 and 32 inside the side guiderail 5. As shown in FIGS. 1 and 6, the slats 19 are fit on the ladder string 18 one by one as in the conventional blind, and the slat spacers 25 are located on the upper portion of each slat. The ladder string 18 passes the webbing roller support center hole 71 of the webbing roller support 7, and then, passes the webbing roller center hole 61 of the webbing roller 6 mounted on the upper portion of the webbing roller support 7. After that, a woven ring part of the ladder string 18 is inserted into the webbing roller ladder string fixing end 63 of the arrowhead type, and then, fixed to the webbing roller ladder string fixing body 64 connected to the webbing roller ladder string fixing end 63, so that the ladder string 18 can control the tilt angle of the slats while rotating the slats at a predetermined angle when being rotated by the rotation of the shaft 10 inserted into the webbing roller 6.

The two pull cords 17 are inserted into two holes formed in the slats 19 respectively, and then, fixed to the bottomrail 20 mounted under the last slat 19. As shown in FIG. 6, each of the pull cords 17 extending upwardly passes the webbing roller support center hole 71 and the webbing roller support roller 74 mounted above the webbing roller support center hole 71 of the webbing roller support 7. After that, as shown in FIG. 7, the pull cord 17 passes under the pulley set 15 mounted into the corner key hole 14-2 of the corner keys 14 and 28 formed at the corner parts of the upper and lower portions of the frame A. After that, the pull cord 17 passes the pulley set 15 inserted into the corner key hole 14-3 formed above the corner key hole 14-2, and then, connected to the inner pull cord holders 26 and 29.

As shown in FIG. 8, the two pull cords 17 connected to the inner pull cord holder 26 (at this time, the pull cords 17 open and close the slats 19 twice as much as the movement distance of the up-down handle 16 pass the rotary winder 26-1 located on the upper portion of the inner pull cord holder 26, and then, fixed and connected to the pulley sets 15 inserted into the corner key hole 14-4 of the corner keys 14 and 28.

As shown in FIG. 10, the two pull cords 17 connected to the inner pull cord holder 29 (at this time, the pull cords 17 open and close the slats 19 five times as much as the movement distance of the up-down handle 16) pass the inner pull cord holder pulley 29-4 mounted above the inner pull cord holder 29, and then, pass the first distance shortening device pulley 30-1 of the first distance shortening device 30. After that, the pull cords 17 pass the through hole 29-9, which is formed in the side supporter 29-6 of the inner pull cord holder 29, from the inside to the outside, pass the through hole 29-7 formed in the upper portion of the inner pull cord holder roller 29-3, and then, are connected and fixed to the cord fixing part 29-5 formed on the lower portion of the inner pull cord holder pulley 29-4.

As shown in FIG. 9, the two pull cords 17 connected to the inner pull cord holder 29 (at this time, the pull cords 17 open and close the slats 19 three times as much as the movement distance of the up-down handle 16) pass the inner pull cord holder pulley 29-4 mounted on the upper portion of the inner pull cord holder 29, and then connected and fixed to the cord fixing parts 31-2 and 32-2 of the distance shortening devices 31 and 32 mounted.

An end of the idle cord 17-1 is fixed to the connectors 30-2 of the first distance shortening device 30 and the holes 31-1 and 32-1 of the second and third distance shortening devices 31 and 32, passes the pulley set 15 inserted into the corner key hole 14-4 of the corner key 14 of the upper portion of the frame, passes the pulley set 15 of the corner key hole of the corner key hole 14-4 of the lower portion of the frame, and then, is connected and fixed to the distance shortening device connectors 30-2, and 30-3 of the first distance shortening devices, the holes 31-1 and 32-1, and the cord fixing parts 31-2, 32-2, 32-6 and 32-7 of the second and third distance shortening devices 31 and 32.

The blind is operated by three methods as follows.

The first method is to open and close the slats 19 twice as much as the movement distance of the up-down handle 16. When the up-down handle 16 is lowered, the two pull cords 17, which move downwardly after passing the slats 19, the two webbing roller supports 7, the webbing roller support roller 74, the pulley set 15 of the corner key hole 14-2 of the corner key 14 and the pulley set 15 of the corner key hole 14-2, move upwardly after passing the rotary winder 26-1 of the inner pull cord holder 26, and are fixed to the pulley set 15 inserted into the corner key hole 14-4 of the corner key 14, are moved downwardly. At this time, the pull cord 17 moving downwardly from the inner pull cord holder 26 and the pull cord 17 moving upwardly through the rotary winder 26-1 are all moved downwardly, and thereby, the pull cords connected to the slats are moved upwardly and open the slats twice as much as the movement distance of the up-down handle 16. To close the slats, the components are operated to the contrary.

The second method is to open and close the slats 19 three times as much as the movement distance of the up-down handle 16. When the up-down handle 16 is lowered, the pull cords 17, which move downwardly after passing the slats 19, the two webbing roller supports 7, the webbing roller support roller 74, the pulley set 15 of the corner key hole 14-2 of the corner key 14 and the pulley set 15 of the corner key hole 14-2, move upwardly after passing the inner pull cord holder pulley of the inner pull cord holder 29 and the pulley of the pulley fixing hole 29-4, and then are fixed to the cord fixing parts 31-2 and 32-2 of the distance shortening devices 31 and 32, are moved upwardly. At this time, the idle cord 17-1, which moves upwardly after passing the distance shortening device connectors 31-1, 31-2, 32-1, 32-7 and 32-6 of the distance shortening devices 31 and 32 and the pulley set 15 of the corner key hole 14-4 of the corner key 14, and the idle cord 17-1, which is fixed after passing the hole 29-8 of the inner pull cord holder side supporter, are connected with the idle cord 17-1, which moves downwardly to be connected to the pulley set 15 of the corner key hole of the corner key 14 located on the bottom of the frame, so that the idle cord 17-1 fixed to the distance shortening device connectors 30-3, 31-2 and 32-2 is idled upwardly.

The two pull cords 17, which move downwardly to the inner pull cord holder 29 from the pulley set 15 of the corner key hole 14-2 of the corner key 14 and the pulley set 15 of the corner key hole 14-2, the pull cords 17, which are fixed to the cord fixing parts 31-2 and 32-2 of the distance shortening devices 31 and 32 after passing the inner pull cord holder pulley and the pulley fixing hole 29-4 of the inner pull cord holder 29 and moving upwardly, and the idle cord 17-1, which is connected to the distance shortening devices 31 and 32, the corner key 14, the inner pull cord holder side supporter hole 29-8 (cord fixing waist) and the corner key 28 located at the bottom of the frame and idles vertically, are all moved up and down, and thereby, the cords connected to the slats are moved upwardly three times as much as the movement distance of the up-down handle 16 to open the slats. To close the slats, the components are operated to the contrary.

The third method is to open and close the slats 19 five times as much as the movement distance of the up-down handle 16. When the up-down handle 16 is lowered, the two pull cords 1, which move downwardly after passing the slats 19, the webbing roller supports 7, the webbing roller support roller 74, the pulley set 15 of the corner key hole 14-2 of the corner key 14 and the pulley set 15 of the corner key hole 14-2, move upwardly after passing the inner pull cord holder pulley of the inner pull cord holder 29, the pulley of the pulley fixing hole 29-4 and the distance shortening device pulley 30-1 of the distance shortening device 30 separated at a predetermined interval from the pulley of the pulley fixing hole 29-4 and are connected to the cord fixing part 29-5 of the inner pull cord holder 29 after passing the hole 29-9 of the inner pull cord holder side supporter and the hole 29-7 located above the inner pull cord holder roller 29-3, are moved downwardly. At this time, the idle cord 17-1, which is knotted to the distance shortening device connector 30-2 of the distance shortening device 30, knotted again at the inner pull cord side supporter hole 29-8 after passing the pulley set 15 of the corner key hole 14-4 of the corner key 14 located on the top of the frame, and connected to the distance shortening device connector 30-3 after passing the pulley set 15 of the corner key hole of the corner key 14 located on the bottom of the frame, is moved downwardly.

The two pull cords 17, which move downwardly to the inner pull cord holder 29 from the pulley set 15 of the corner key hole 14-2 of the corner key 14 and the pulley set 15 of the corner key hole 14-2, the two pull cords 17, which move upwardly to the distance shortening device pulley 30-1 of the distance shortening device 30 after passing the inner pull cord holder pulley and the pulley fixing hole 29-4 of the inner pull cord holder 29, the two pull cords 17, which pass the hole 29-9 of the inner pull cord holder side supporter of the inner pull cord holder 29 and the hole 29-7 located in the upper portion of the inner pull cord holder roller, and are fixed to the cord fixing part 29-5 of the inner pull cord holder 29 to be lowered, and the idle cord 17-1, which moves upwardly after passing the pulley set 15 of the corner key hole 14-4 of the corner key 14 located on the upper portion of the frame, are all moved downwardly and fixed after passing the hole 29-8 of the inner pull cord holder supporter. Continuously, the idle cord 17-1 is connected to the distance shortening device connector 30-3 to rotate idly after passing the pulley set 15 of the corner key hole of the corner key 14 located on the bottom of the frame. The idle cord 17-1 moving vertically is moved downwardly together with the pull cords 17, and thereby, the cords connected to the slats are moved upwardly five times as much as the movement distance of the up-down handle to open the slats. To close the slats, the components are operated to the contrary.

As described above, the present invention has several effects as follows.

First, the present invention minimize friction coefficient when the pull cords are moved by roller are mounted on the webbing roller supports and the corner keys to prevent loosening of the pull cords, and thereby, the bottom bar and the slats of the horizontal blind can be kept at a level when the up-down handle is operated vertically.

Second, the smooth movement of wheels located on the upper portion of the inner pull cord holder and the lower portion of the up-down handle can prevent a rise of the friction coefficient due to the strong magnetic force of the magnets, which are located on the upper portion of the inner pull cord holder and the lower portion of the up-down handle required for maintaining weight of the horizontal blind.

Third, in the conventional blind, the inner pull cord holder just serves to lock the pull cords in such a manner that the knot of the pull cords are fixed by pressing the pull cords with a clip to maintain the leveled state without separation of the pull cords when the leveled state of the slats and the bottom bar of the blind are controlled, but the slats and the bottom bar cannot be controlled to the leveled state once being tilted due to loosening of the pull cords or other factors. However, in the present invention, a bar of a rotary disc located on the upper portion of the inner pull cord holder not only locks the pull cords but also rotates to pull the up-down handle downwardly helping the smooth rotation of the pull cords when the slats and the bottom bar of the blind are tilted, and thereby, the blind can automatically maintain the leveled state.

Fourth, differently from the conventional blinds having bolt tightening holes located in the side or rear surface, in the present invention, the bolt tightening holes of the webbing roller and the helical gear are located in the upper portion. Therefore, the prevent invention can improve convenience in work and productivity by directly performing the bolt tightening work after assembly of the shaft without rotating the webbing roller and the helical gear to ¼ and ½ revolutions.

Fifth, the webbing roller has a short end of the webbing roller ladder string fixing part of the webbing roller and the webbing roller center hole, so that the ladder string can easily reach the end of the webbing roller ladder string fixing part along the webbing roller center hole serving as a guider of the cord through the webbing roller support center hole. As the result, the ladder string can be easily inserted into the hole through the arrowhead of the short ladder string fixing end. Furthermore, the webbing roller ladder string fixing body supporter 66 located between the webbing roller ladder string fixing end 63 and the webbing roller ladder string fixing body 64 on the webbing roller flat top prevents the webbing roller ladder string fixing body 64 from being bent or cut downwardly by weight of the horizontal blind. Moreover, the webbing roller is directly tightened with a bolt through the hole located in the upper portion of the webbing roller without rotation. Therefore, the present invention can improve productivity and safety of the product.

Sixth, when the blind is moved vertically, the right and left portions of the slats and the bottom bar and the bottom of the bottom bar are inserted into an opened part of the frame of the form of a "ㄷ" Korean character, so that the frame not only serves as a guiderail of the slats and the bottom bar but also completely cover all gaps.

Seventh, in case of using the conventional blind, a user has to move the up-down handle as much as the vertical movement distance of the horizontal blind when opening and closing the blind. However, the prevent invention can provide the same effect as the conventional blind only by moving the up-down handle to ½, ⅓ or ⅕ of the vertical movement distance of the horizontal blind using the pull cord holders 26 and 29, the corner key 14 for shortening the distance to ½, the second and third distance shortening devices 31 and 32 for shortening distance to ⅔, and the first distance shortening device 30 for shortening distance to ⅘. As the result, the present invention can be utilized on windows mounted at lower parts or long windows, and thereby, the horizontal blind can be operated vertically to a desired position even though the up-down handle is moved short.

Eighth, the horizontal blind of the present invention is mounted between the double windows, and the outer frame is formed by the space bars having dehumidifying agent inside. So, the present invention can solve the problems of the conventional blind in which operating components are embedded, i.e., the exposure of the tilt rod for controlling the pull cords and its related components and rotational angle of the slats, inconvenience in use, frequent occurrence of stain and malfunction, and accumulation of dust on the slats and the ladder string. As the result, the present invention can extend life of the product, maintain cleanness of offices and houses, and maximize effects of interior design. Furthermore, the present invention can naturally conform to the Fire Services Act providing that no ornaments or screen are mounted in front of fireproof windows.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A blind comprising:

a rectangular frame; comprising a front surface and a back surface and at least one side guiderail;

a front window attached to the front surface of the frame;

a back window attached to the back surface of the frame;

a slat part comprising one or more slats and a bottom rail wherein the one or more slats and the bottom rail are operatively connected to the frame;

an upper movable part comprising one or more drum parts and a helical gear part installed within the frame, wherein the helical gear part is coupled to a front tilting mechanism mounted externally on the frame for controlling a tilt angle of the slats; and a side movable part installed within the side guiderail for opening and closing the slat part, the side movable part comprising an up-down handle coupled to the side movable part and mounted externally on the frame for movement along a length of the side guiderail to raise or lower the slat part, wherein a total distance required to move the up-down handle to completely raise or lower the slat part is a fraction of the length of the side guiderail, wherein the up down handle need only be moved ⅕ the length of the side guide rail to completely raise or lower the blind.

2. The blind as set forth in claim 1 wherein the up down handle need only be moved ½ the length of the side guide rail to completely raise or lower the blind.

3. The blind as set forth in claim 1 wherein the helical gear part comprises:

a gear;

a groove spirally formed in a surface of the gear;

a shaft extending from at least one end of the gear;

a helical gear movable part with an inserting hole shaped to receive the gear, the helical gear movable part having a protrusion located and extending into the inserting hole, the protrusion engages the groove in the helical gear so that movement of the helical gear movable part causes the gear to rotate.

4. The blind as set forth in claim 3 wherein the one or more drum parts comprise one or more webbing rollers operatively connected to the shaft causing the rollers to rotate along with the shaft.

5. The blind as set forth in claim 4 wherein the upper movable part further comprises one or more ladder strings connected to the webbing rollers and to the one or more slats such that rotation of the webbing rollers in a first direction causes the one or more slats to tilt in and rotation of the webbing roller in a second direction causes the one or more slats to tilt out.

6. The blind as set forth in claim 5 wherein the front tilting mechanism is coupled to the helical gear movable art.

7. The blind as set forth in claim 6 wherein the front tilting mechanism further comprises a first magnet and wherein the helical gear movable part comprises a second magnet that is magnetically attracted to the first magnet.

8. The blind as set forth in claim 4 wherein the upper movable part further comprises one or more webbing roller supports which support the one or more webbing rollers.

9. A blind comprising:

a rectangular frame; comprising a front surface and a back surface and at least one side guiderail;

a front window attached to the front surface of the frame;

a back window attached to the back surface of the frame;

a slat part comprising one or more slats and a bottom rail wherein the one or more slats and the bottom rail are operatively connected to the frame;

an upper movable part comprising one or more drum parts and a helical gear part installed within the frame, wherein the helical gear part is coupled to a front tilting mechanism mounted externally on the frame for controlling a tilt angle of the slats; and a side movable part installed within the side guiderail for opening and closing the slat part, the side movable part comprising an up-down handle coupled to the side movable part and mounted externally on the frame for movement along a length of the side guiderail to raise or lower the slat part, wherein a total distance required to move the up-down handle to completely raise or lower the slat part is a fraction of the length of the side guiderail, wherein the up down handle need only be moved ⅓ the length of the side guide rail to completely raise or lower the blind.

10. A blind comprising:

a rectangular frame; comprising a front surface and a back surface and at least one side guiderail;

a front window attached to the front surface of the frame;

a back window attached to the back surface of the frame;

a slat part comprising one or more slats and a bottom rail wherein the one or more slats and the bottom rail are operatively connected to the frame;

an upper movable part comprising one or more drum parts and a helical gear part installed within the frame, wherein the helical gear part is coupled to a front tilting mechanism mounted externally on the frame for controlling a tilt angle of the slats; and a side movable part installed within the side guiderail for opening and closing the slat part, the side movable part comprising an up-down handle coupled to the side movable part and mounted externally on the frame for movement along a length of the side guiderail to raise or lower the slat part, wherein a total distance required to move the up-down handle to completely raise or lower the slat part is a fraction of the length of the side guiderail.

wherein the side movable part comprises:

one or more pull cords;

one or more inner pull cord holders;

at least one of a first, second and third distance shortening devices; and one or more corner keys comprising one or more pulley sets, wherein the one or more pull cords run through the one or more pulley sets and connect to the at least one of the first, second and third distance shortening devices, the one or more inner pull cord holders and the slat part.

11. The blind as set forth in claim 10 wherein the one or more inner pull cord holders comprise an inner pull cord holder magnet and wherein the up down handle is magnetically coupled to one of the one or more inner pull cord holders.

12. The blind as set forth in claim 10 wherein the first distance shortening device comprises:

plates;

a first distance shortening device pulley mounted between the plates; and distance shortening device connectors formed at ends of the plates.

13. The blind as set forth in claim 10 wherein the second distance shortening device comprises:

a first cylindrical bar;

a first cord fixing part projecting from a portion of the first cylindrical bar, the first cord fixing part having holes for fixing the one or more pull cords;

a second cord fixing part comprising a hole in the first cylindrical bar for fixing the one or more cords;

a first side fixing part formed on a side surface of the first cylindrical bar; and a second distance shortening device cover inserted onto another portion of the first cylindrical bar, the second distance shortening device cover fixing the one or more pull cords in the hole in the first cylindrical bar and the first side fixing part securing the second distance shortening device cover.

14. The blind as set forth in claim 10 wherein the third distance shortening device comprises:

a third cylindrical bar;

a third cord fixing part projecting from an upper portion of the third cylindrical bar for fixing the one or more pull cords;

one or more fourth cord fixing parts comprising holes in the third cylindrical bar, wherein the holes are formed from a lower surface in an upward direction;

a second side fixing part formed on a side surface of the third cylindrical bar for preventing separation of the cord inserted into the one or more fourth cord fixing parts; and a third distance shortening device cover inserted onto another portion of the third cylindrical bar for fixing the one or more pull cords and the second side fixing part securing the second distance shortening device cover.

15. A method for making a blind, the method comprising:

providing a rectangular frame comprising a front surface and a back surface and at least one side guiderail;

attaching a front window to the front surface of the frame;

attaching a back window to the back surface of the frame;

operatively connecting a slat part to the frame between the windows, the slat part comprising one or more slats and a bottom rail;

installing an upper movable part comprising one or more drum parts and a helical gear part within the frame, wherein the helical gear part is coupled to a front tilting mechanism mounted externally on the frame for controlling a tilt angle of the slats; and installing a side movable part within the side guiderail for opening and closing the slat part;

connecting an up-down handle to the side movable part, the handle is mounted externally on the frame for movement along a length of the side guiderail to raise or lower the slat part, wherein a total distance required to move the handle to completely raise or lower the slat part is a fraction of the length of the side guiderail, wherein the handle need only be moved ⅕ the length of the side guide rail to completely raise or lower the blind.

16. The method as set forth in claim 15 wherein the up down handle need only be moved ½ the length of the side guide rail to completely raise or lower the blind.

17. The method as set forth in claim 15 wherein the helical gear part comprises:

a gear;

a groove spirally formed in a surface of the gear;

a shaft extending from at least one end of the gear;

a helical gear movable part with an inserting hole shaped to receive the gear, the helical gear movable part having a protrusion located and extending into the inserting hole, the protrusion engages the groove in the helical gear so that movement of the helical gear movable part causes the gear to rotate.

18. The blind as set forth in claim 17 wherein the one or more drum parts comprise one or more webbing rollers operatively connected to the shaft causing the rollers to rotate along with the shaft.

19. The method as set forth in claim 18 wherein the upper movable part further comprises one or more ladder strings connected to the webbing rollers and to the one or more slats such that rotation of the webbing rollers in a first direction causes the one or more slats to tilt in and rotation of the webbing roller in a second direction causes the one or more slats to tilt out.

20. The blind as set forth in claim 19 wherein the front tilting mechanism is coupled to the helical gear movable art.

21. The method as set forth in claim 20 wherein the front tilting mechanism further comprises a first magnet and wherein the helical gear movable part comprises a second magnet that is magnetically attracted to the first magnet.

22. The blind as set forth in claim 19 wherein the upper movable part further comprises one or more webbing roller supports which support the one or more webbing rollers.

23. A method for making a blind, the method comprising:

providing a rectangular frame comprising a front surface and a back surface and at least one side guiderail;

attaching a front window to the front surface of the frame;

attaching a back window to the back surface of the frame;

operatively connecting a slat part to the frame between the windows, the slat part comprising one or more slats and a bottom rail;

installing an upper movable part comprising one or more drum parts and a helical gear part within the frame, wherein the helical gear part is coupled to a front tilting mechanism mounted externally on the frame for controlling a tilt angle of the slats; and installing a side movable part within the side guiderail for opening and closing the slat part;

connecting an up-down handle to the side movable part, the handle is mounted externally on the frame for movement along a length of the side guiderail to raise or lower the slat part, wherein a total distance required to move the handle to completely raise or lower the slat part is a fraction of the length of the side guiderail:

wherein the side movable part comprises: one or more pull cords;

one or more inner pull cord holders;

at least one of a first, second and third distance shortening devices; and one or more corner keys comprising one or more pulley sets, wherein the one or more pull cords run through the one or more pulley sets and connect to the at least one of the first, second and third distance shortening devices, the one or more inner pull cord holders and the slat part.

24. The blind as set forth in claim 23 wherein the one or more inner pull cord holders comprise an inner pull cord holder magnet and wherein the up down handle is magnetically coupled to one of the one or more inner pull cord holders.

25. The method as set forth in claim 23 wherein the first distance shortening device comprises:

plates;

a first distance shortening device pulley mounted between the plates; and distance shortening device connectors formed at ends of the plates.

26. The method as set forth in claim 23 wherein the second distance shortening device comprises:

a first cylindrical bar;

a first cord fixing part projecting from a portion of the first cylindrical bar, the first cord fixing part having holes for fixing the one or more pull cords;

a second cord fixing part comprising a hole in the first cylindrical bar for fixing the one or more cords;

a first side fixing part formed on a side surface of the first cylindrical bar; and a second distance shortening device cover inserted onto another portion of the first cylindrical bar, the second distance shortening device cover fixing the one or more pull cords in the hole in the first cylindrical bar and the first side fixing part securing the second distance shortening device cover.

27. The method as set forth in claim 23 wherein the third distance shortening device comprises:

a third cylindrical bar;

a third cord fixing part projecting from an upper portion of the third cylindrical bar for fixing the one or more pull cords;

one or more fourth cord fixing parts comprising holes in the third cylindrical bar, wherein the holes are formed from a lower surface in an upward direction;

a second side fixing part formed on a side surface of the third cylindrical bar for preventing separation of the cord inserted into the one or more fourth cord fixing parts; and a third distance shortening device cover inserted onto another portion of the third cylindrical bar for fixing the one or more pull cords and the second side fixing part securing the second distance shortening device cover.

28. A method for making a blind, the method comprising:

providing a rectangular frame comprising a front surface and a back surface and at least one side guiderail;

attaching a front window to the front surface of the frame;

attaching a back window to the back surface of the frame;

operatively connecting a slat part to the frame between the windows, the slat part comprising one or more slats and a bottom rail;

installing an upper movable part comprising one or more drum parts and a helical gear part within the frame, wherein the helical gear part is coupled to a front tilting mechanism mounted externally on the frame for controlling a tilt angle of the slats; and installing a side movable part within the side guiderail for opening and closing the slat part;

connecting an up-down handle to the side movable part, the handle is mounted externally on the frame for movement along a length of the side guiderail to raise or lower the slat part, wherein a total distance required to move the handle to completely raise or lower the slat part is a fraction of the length of the side guiderail:

wherein the up down handle need only be moved ⅓ the length of the side guide rail to completely raise or lower the blind.

* * * * *